US008317039B2

(12) United States Patent
Norman

(10) Patent No.: US 8,317,039 B2
(45) Date of Patent: Nov. 27, 2012

(54) ROLLING QUARTER PALLET DISPLAY SYSTEM AND SHIPPING CONTAINER

(75) Inventor: Christopher Norman, Menomonee Falls, WI (US)

(73) Assignee: Menasha Corporation, Neenah, WI (US)

( * ) Notice: Subject to any disclaimer, the term of this patent is extended or adjusted under 35 U.S.C. 154(b) by 366 days.

(21) Appl. No.: 12/621,221

(22) Filed: Nov. 18, 2009

(65) Prior Publication Data

US 2010/0133215 A1 Jun. 3, 2010

Related U.S. Application Data

(60) Provisional application No. 61/116,879, filed on Nov. 21, 2008.

(51) Int. Cl.
*A47F 7/00* (2006.01)

(52) U.S. Cl. ..... 211/60.1

(58) Field of Classification Search ..... 211/60.1, 211/126.1, 188, 194, 182, 49.1, 59.4, 71.01, 211/72, 73; 108/53.5; 229/122.21, 919; 206/736, 320, 384, 591–593, 430, 443, 586, 206/509–511, 499, 766, 453
See application file for complete search history.

(56) References Cited

U.S. PATENT DOCUMENTS

| | | | | |
|---|---|---|---|---|
| 1,912,847 | A | 6/1933 | Robert | |
| 2,798,685 | A | 7/1957 | Mooney | |
| 3,000,602 | A * | 9/1961 | O'Brien | 108/14 |
| 3,026,015 | A | 3/1962 | Severn | |
| 3,026,078 | A | 3/1962 | Simkins | |
| 3,480,196 | A | 11/1969 | Simas | |
| 3,528,559 | A * | 9/1970 | Miller | 211/195 |
| 3,730,417 | A | 5/1973 | Lawson | |
| 3,857,494 | A * | 12/1974 | Giardini | 211/194 |
| 3,879,053 | A | 4/1975 | Chvala | |
| 4,085,847 | A | 4/1978 | Jacalone | |
| 4,171,741 | A | 10/1979 | Fish | |
| 4,292,901 | A * | 10/1981 | Cox | 108/55.1 |
| 4,503,973 | A | 3/1985 | Andersson | |
| 4,610,355 | A | 9/1986 | Maurer | |

(Continued)

FOREIGN PATENT DOCUMENTS

EP 629557 A1 12/1994

(Continued)

OTHER PUBLICATIONS

LeBlanc, Rick, "Limits on Export Pallets Creating Corrugated Window of Opportunity; Corrugated Pallet Suppliers Experiencing Renewed Interest for Export, Domestic Markets"; http://www.palletenterprise.com/articledatabase/view.asp?articleID=649, 7 pages (Apr. 1, 2002).

(Continued)

*Primary Examiner* — Jennifer E. Novosad
(74) *Attorney, Agent, or Firm* — Ungaretti & Harris LLP

(57) ABSTRACT

A display system is provided having a base and a plurality of trays supported by posts. The base includes a pallet having a plurality of wheels extending from a lower surface. The base supports a first tray formed from a corrugated material. A plurality of posts extending from an upper surface of the pallet support a second tray formed from a corrugated material. Subsequent trays can be supported by additional posts. The trays support a plurality of goods for sale. Corrugated spacer pieces can be positioned in the trays as necessary depending on the size and shape of the goods supported in the tray.

10 Claims, 6 Drawing Sheets

U.S. PATENT DOCUMENTS 4,673,092 A * 6/1987 Lamson et al. ..... 211/188
4,836,379 A * 6/1989 Shaw ..... 206/523
4,850,284 A 7/1989 DeGroot et al.
4,852,756 A 8/1989 Holladay
4,863,024 A 9/1989 Booth
4,877,137 A 10/1989 Govang et al.
4,911,084 A 3/1990 Sato
5,067,418 A 11/1991 Carter
5,119,740 A 6/1992 Carter
5,125,520 A * 6/1992 Kawasaki ..... 211/133.1
5,176,265 A 1/1993 Bennett
5,195,440 A 3/1993 Gottlieb
5,269,219 A 12/1993 Juvik-Woods
5,272,990 A 12/1993 Carter
5,357,875 A 10/1994 Winebarger et al.
5,388,531 A 2/1995 Crews et al.
5,413,053 A 5/1995 Vannatta
5,427,019 A 6/1995 Moorman
5,465,672 A 11/1995 Boyse et al.
5,487,344 A 1/1996 Hutchison
5,487,345 A 1/1996 Winebarger et al.
5,520,120 A 5/1996 Badger
5,528,994 A 6/1996 Iseli
5,540,536 A 7/1996 Hoedl
5,543,205 A 8/1996 Liebel
5,590,606 A 1/1997 Crews et al.
5,603,258 A 2/1997 Besaw
5,622,306 A 4/1997 Grigsby et al.
5,672,412 A 9/1997 Phares et al.
5,685,234 A 11/1997 Grigsby et al.
D395,534 S 6/1998 Besaw
5,794,542 A 8/1998 Besaw
5,809,903 A 9/1998 Young, Jr.
5,816,172 A 10/1998 Carter
5,832,841 A 11/1998 Crews et al.
5,881,652 A 3/1999 Besaw
5,918,744 A 7/1999 Bringard et al.
5,980,008 A 11/1999 Stoever
5,996,366 A 12/1999 Renard
5,996,510 A 12/1999 Harpman et al.
D419,275 S 1/2000 Carter
D419,744 S 1/2000 Carter
6,012,399 A 1/2000 Carter
6,070,726 A 6/2000 Graham
6,076,475 A 6/2000 Kuhn et al.
6,126,131 A 10/2000 Tietz
6,135,030 A 10/2000 Besaw
D433,782 S 11/2000 Carter
D453,057 S 1/2002 Sewell
6,354,229 B1 3/2002 Heidtke
6,357,587 B1 * 3/2002 Melms, Jr. ..... 206/326
6,394,003 B1 5/2002 Lacy, III
6,612,247 B1 9/2003 Pistner et al.
6,769,368 B2 8/2004 Underbrink et al.
6,902,074 B2 * 6/2005 Albrecht ..... 211/189
6,905,021 B2 6/2005 Polumbaum et al.
7,066,342 B2 * 6/2006 Baechle et al. ..... 211/191
7,111,735 B2 * 9/2006 Lowry ..... 206/586
7,137,517 B2 * 11/2006 Lowry et al. ..... 211/188
7,546,927 B2 * 6/2009 Lowry et al. ..... 211/126.1
2002/0189507 A1 12/2002 Benner
2003/0111383 A1 * 6/2003 Qiu et al. ..... 206/586
2007/0193479 A1 * 8/2007 Slaats ..... 108/53.1
2011/0266177 A1 * 11/2011 Lowry et al. ..... 206/320

FOREIGN PATENT DOCUMENTS

JP 06278746 A 10/1994

OTHER PUBLICATIONS

"Solid Wood Packing Materials to Argentina"; http://www.corrugatedprices.com/pallets/swarg.html, 2 pages (Feb. 5, 2002). Note: Applicant was unable to locate this reference, but believes that is available to the Examiner in the application file at the U.S. Patent and Trademark Office.

* cited by examiner

ROLLING QUARTER PALLET DISPLAY SYSTEM AND SHIPPING CONTAINER

CROSS-REFERENCE TO RELATED APPLICATIONS

This application claims the benefit of U.S. Provisional Patent Application No. 61/116,879, filed Nov. 21, 2008, which is hereby incorporated by reference as if fully set forth herein.

FEDERALLY SPONSORED RESEARCH OR DEVELOPMENT

N/A

FIELD OF THE INVENTION

The present invention is generally directed to a display system having a plurality of levels supported by a pallet with rollers and a shipping container for the display system, and is more particularly directed to a quarter pallet with rollers supporting a plurality of shelves or levels for holding goods wherein each shelf is configured to support and display one or more particular types of goods, and a shipping container for shipping a loaded display system.

BACKGROUND OF THE INVENTION

There is an inherent desire for product manufacturers to get their product to the floor as easily as possible and in an aesthetically pleasing product display to catch the attention of the consumer. Retailers share this same desire. However, retailers are faced with the problem of having to unpack product when it arrives and put it into separate shelving for display. This takes time and delays product from being placed on store shelves upon its arrival at the retailer. Moreover, once the displays are set up at the retail location, they are not easily moveable preventing a retailer from changing the retail layout or footprint of the displayed products.

The present invention provides an improved display system and shipping container for shipping goods and displaying them at a desired location.

SUMMARY OF THE INVENTION

The present invention provides a display system that is ready to be displayed on the retail floor shortly after arrival at a retail location. Additionally, the display is easily moveable from one location in the retail store to another. The system reduces the retailer's labor and time to set up a product display, and allows the retailer to display the product in a preferred location.

In accordance with one embodiment of the invention a display system that can be shipped containing goods and easily rolled onto position is provided. The display system comprises a base including a pallet, such as a generally rectangular wood pallet, supported by a plurality of wheels extending from a lower surface of the pallet. The base includes a first corrugated tray supported on an upper surface of the pallet which is configured to support a plurality of goods. A first plurality of joiner posts extend upward from the pallet and a second corrugated tray is supported by the plurality of joiner posts. The second corrugated tray is configured to support a plurality of goods.

One or more support pieces or spacers can be used in conjunction with the tray to control the positioning of the plurality of goods in the first tray. The support pieces can also be formed from a corrugated material.

The display system can further comprise a second set of joiner posts extending upward from the second corrugated tray. A third corrugated tray is supported by the second set of joiner posts. The third corrugated tray is configured to support a plurality of goods.

A plurality of corner extrusion pieces can be provided wherein each piece is positioned over one of the joiner posts of the plurality of joiner posts. The corner extrusion pieces include a hollow cylindrical central portion configured to enclose a joiner post. Additionally, the corner extrusion pieces each include a first planar portion extending from the central portion and second planar portion extending from the central portion. The plan portions generally extend at 90 degree angles to have a corner shape.

A third set of joiner posts can extend upward from the third corrugated tray to support a fourth corrugated tray. A corrugated advertising panel can be disposed on an upper surface of the fourth corrugated tray.

The display system can further comprise a shipping container for shipping the display system as set up and containing goods. The shipping container has a base portion configured to support the pallet portion of the display system, and a main body portion connectable to the base portion for enclosing the rest of the display system.

In accordance with another embodiment of the invention, a rollable display system is provided. The display system comprises a generally rectangular pallet having a plurality of wheel casters positioned in corners of the pallet. Each caster has a receiving portion extending from a lower surface of the pallet for receiving a wheel, and a base portion extending upward from an upper surface of the pallet. A plurality of wheels is secured to the receiving portions of the plurality of wheel casters. A first plurality of corner support pieces having a lower end and an upper end extend upward from the base portion of the casters. Each corner support piece has a hollow central portion, a first planar portion extending from the hollow central portion and a second planar portion extending from the hollow central portion. The corner support pieces can be extruded. Each corner support piece is connected to a corresponding one of the plurality of caster bases wherein the caster base is positioned in the hollow central portion of the corner support piece. A first corrugated tray is supported on the upper surface of the pallet and a second corrugated tray is supported at the upper ends of the first plurality of corner support pieces.

A first plurality of joiner posts are positioned in the hollow central portions of the first plurality of corner pieces. The first plurality of joiner posts each include an upper portion that extends upward from an upper surface of the second tray.

A second plurality of corner support pieces can be provided. Again, each corner support piece has a hollow central portion, a first planar portion extending from the hollow central portion and a second planar portion extending from the hollow central portion. Each corner support piece is connected to a corresponding one of the plurality of the first plurality of joiner posts wherein the upper end of the joiner post is positioned in the hollow central portion of the corner support piece. A third corrugated tray is supported by the second plurality of corner support pieces.

This sequence of corner support pieces, joiner posts and trays can be repeated to provide a system with additional levels of trays for supporting goods. Additionally, each tray can include one or more corrugated support pieces to support or otherwise position goods on the trays. An advertising panel supported can be supported in the uppermost tray.

In accordance with yet another embodiment of the invention, a quarter pallet rolling display assembly with a shipping container is provided. The assembly comprises a base assembly with a bottom surface configured to support a transport element and a top surface configured to support a first joiner element connecting the base assembly. A first tray is positioned above the base assembly. A first spacer in the first tray is configured to accept a first product. A second joiner element connects the first tray to a second tray. A second spacer in the second tray is configured to accept a second product which is different than the first product. A shipping tray with a shipping support is configured to receive and secure the base assembly and a shipping container is provided configured with a side portion and a top portion to cover the base assembly, the first tray and the second tray.

Other features and advantages of the invention will be apparent from the following specification taken in conjunction with the following Figures and Attachments.

BRIEF DESCRIPTION OF THE FIGURES

To understand the present invention, it will now be described by way of example, with reference to the accompanying Figures in which.

DETAILED DESCRIPTION OF THE INVENTION

While this invention is susceptible of embodiments in many different forms, there is shown in the Figures and will herein be described in detail preferred embodiments of the invention with the understanding that the present disclosure is to be considered as an exemplification of the principles of the invention and is not intended to limit the broad aspect of the invention to the embodiments illustrated.

Figure 1:
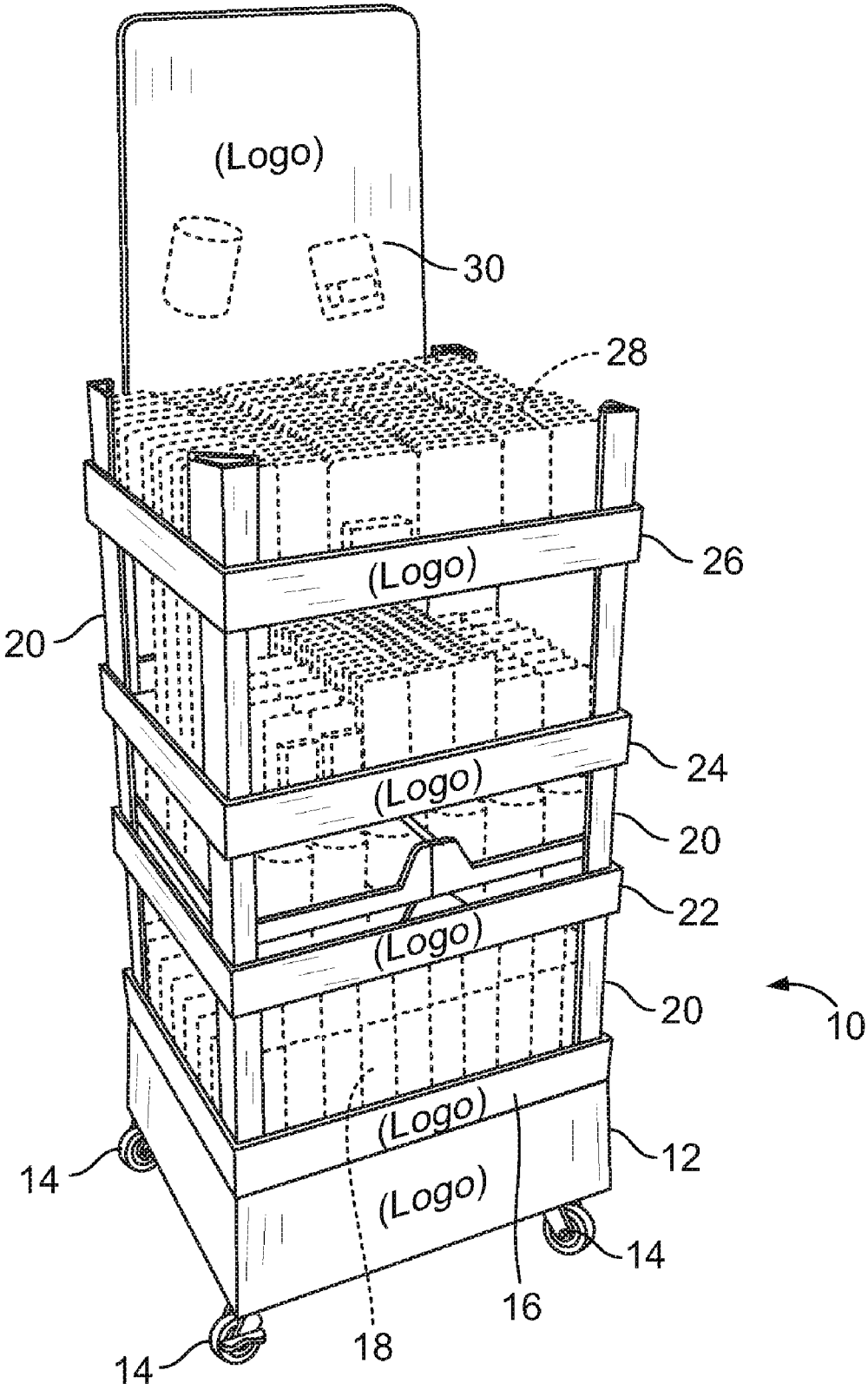
FIG. 1 is a perspective view of a quarter pallet display system in accordance with the present invention.

Referring to FIG. 1, a quarter pallet display system 10 is shown. The display system 10 includes a lower pallet 12 supported by four wheels 14. The wheels 14 are connected to the bottom of the pallet 12 by casters. The pallet is referred to as a quarter pallet because it is one fourth the size of a typical pallet used for shipping goods. However, the pallet can be any desired size and shape suitable for shipping goods.

The pallet 12 supports a first tray 16 holding a plurality of first goods 18 (e.g., aerosol containers). A plurality of joiner tubes or posts (surrounded by corner support pieces 20)—one in each corner of the first tray 16—support a second tray 22 holding a plurality of second goods. In a similar manner additional joiner posts/corner support pieces 20 support a third tray 24 with a plurality of third goods, and (similarly) a fourth tray 26. The fourth (or top) tray 26 supports a plurality of fourth goods 28, and an advertising display board 30.

As illustrated in FIGS. 2A-2D, the pallet 12 of the the display system 10 is constructed having a wood base 32 (however, the display system can alternatively be formed using plastic or other similar material for the base). The wood base 32 includes a plurality of caster bases 34 having a bottom or receiving portion secured to a bottom surface of the wood base 32. The caster bases 34 include an upper portion that extends upward, through and above the upper surface of the wood base 12. Two wheels 12 are provided that include a locking caster 36, and two wheels 12 are provided having a non-locking caster 38. All four wheels are secured to the receiving portions of the caster bases 34. The locking casters can be utilized to lock the wheels when the display system 10 is rolled into the desired location at the retail store to prevent the display system 10 from moving.

The first tray 16 is supported on an upper surface of the wood base 32. The first tray 16 is formed from a corrugated material, such as cardboard. The first tray 16 can include apertures or cut-outs to allow for the upper portion of the caster bases to extend upward above the surface of the pallet 12.

Figure 2A:
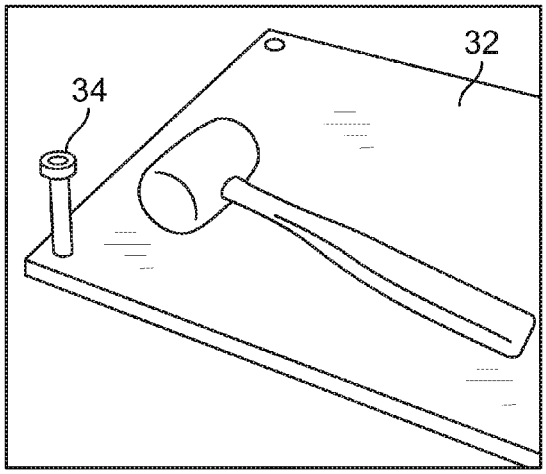
FIGS. 2A-2D are perspective views of the base portion of the display system of FIG. 1 as it is being assembled.
Figure 2B:
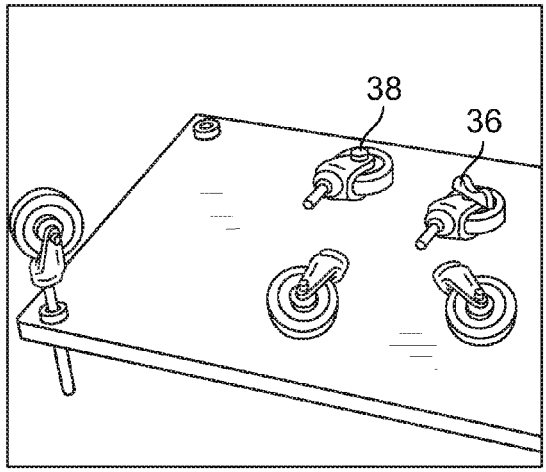
Figure 2C:
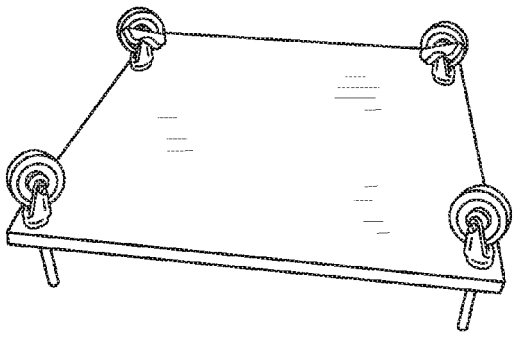
Figure 2D:
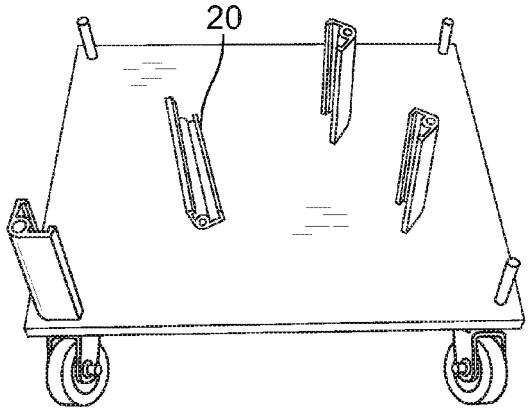
Figure 3:
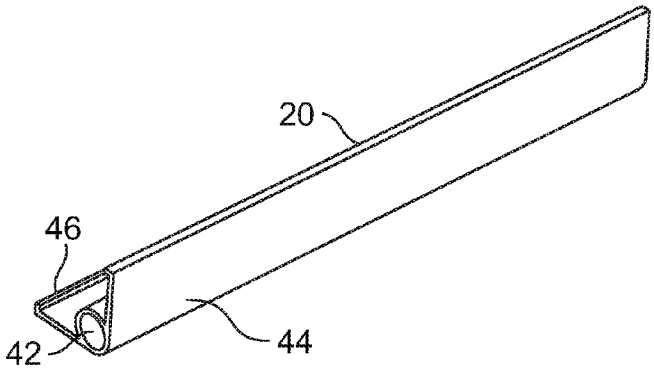
FIG. 3 is a perspective view of a corner support piece of the display system of FIG. 1.

A first set of four corner support pieces 20 are secured to the corners of the upper surface of the wood base 32. The corner support pieces 20 each include a hollow circular center portion 42 and two planar side portions 44, 46 as shown in FIG. 3. The corner support pieces 20 are preferably extruded in an extrusion process. The hollow center portion 42 of each corner support piece 20 is positioned over the upper portion of a corresponding one of the caster bases 34 as illustrated in FIG. 2D such that the upper portion of the caster is inserted into a lower portion of the hollow center portion 42 of the corner support piece 20.

Figure 4:
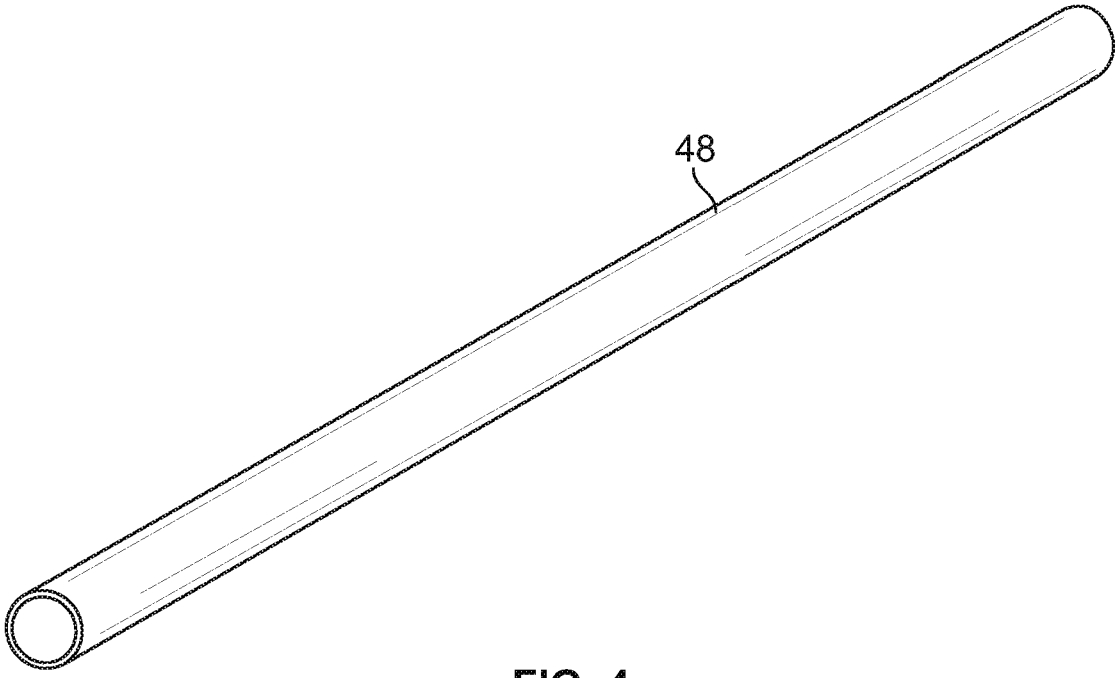
FIG. 4 is a perspective view of a joiner tube or post of the present invention.

Four joiner posts 48 are inserted into the tops of the hollow center portion 42 of the corner support pieces 20 until a lower portion of each post 48 contacts the upper portion of the caster base inserted into the bottom of the corner support piece 20. The joiner posts 48 are preferably tubular as shown in FIG. 4; however, solid and/or non-cylindrical posts can be used. The joiner posts 48 are sized so that when inserted into the top of the corner support piece 20, an upper portion of each post 48 extends upward above the end of the corner support piece 20. This upper portion can be used to support another set of corner support pieces 20. The joiner posts 48 of the last level can be sized so that they do not extend beyond the upper surface of the level.

The first set of corner support pieces 20 and joiner posts 48 support the second tray 22. The second tray 22 is also preferably formed from a corrugated material. The second tray 22 is also configured to include apertures or cut-out portions to allow the upper ends of the joiner posts 48 to extend upward from the upper surface of the tray 22.

Figure 5:
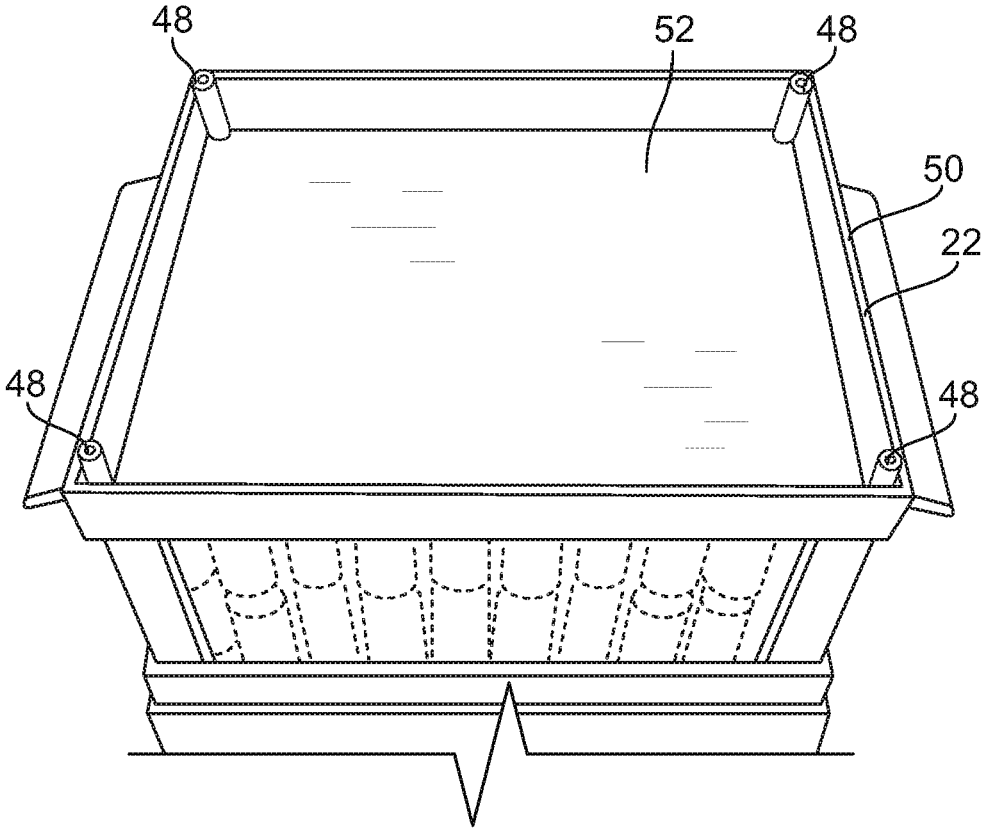
FIG. 5 is a perspective view of the first and second levels of the display system in accordance with the present invention.

FIG. 5 illustrates the joiner posts 48 extending upward above the upper surface of the second tray 22. The second tray includes four side walls 50 surrounding a central bottom wall 52. The joiner posts 48 extend to just below or level with the top edge of the side walls 50.

Figure 6:
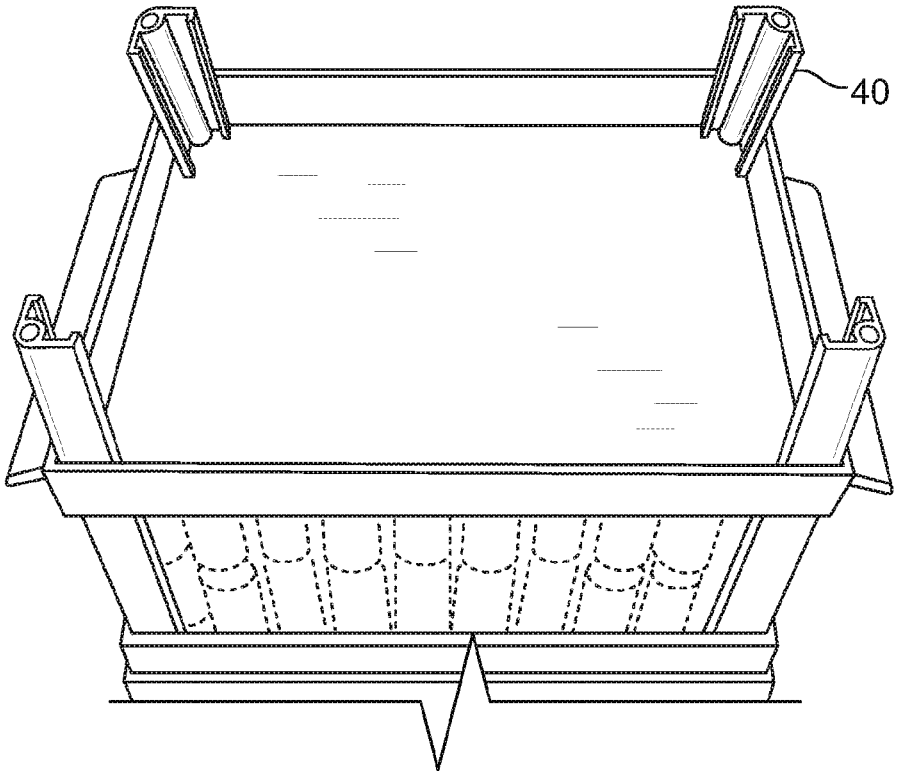
FIG. 6 is a perspective view of the first and second levels of the display including corner support pieces.
Figure 7:
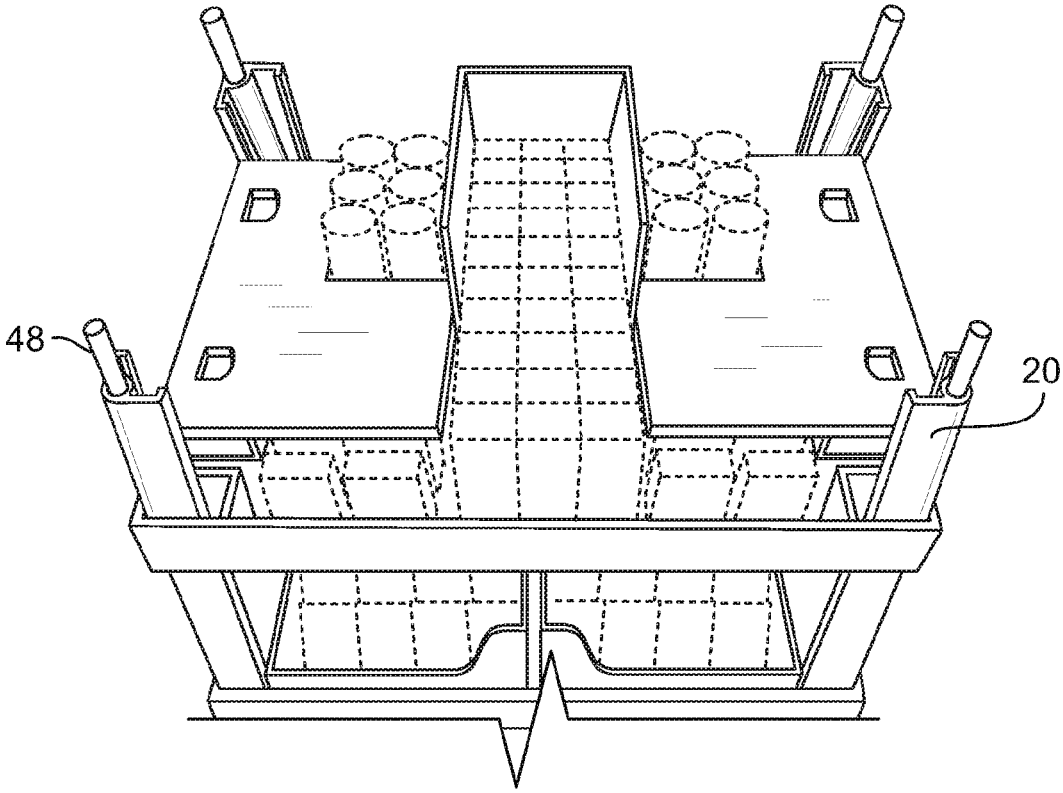
FIG. 7 is a perspective view of the first and second levels of the display of FIG. 6 with joiner posts positioned in the corner support pieces.

FIG. 6 illustrates placement of a second set of corner support pieces 20 over the upper ends of the joiner posts 48. The second set of corner support pieces 20 is positioned to support the third tray 24. Additional joiner posts 48 can be inserted into the upper portions of the corner support pieces 20 prior to placement of the third tray 24 as illustrated in FIG. 7. The joiner posts 48 rest on the upper ends of the lower joiner posts inserted into the bottom of the second set of corner support pieces and include upper ends that extend upward above the ends of the second set of corner support pieces 20. These joiner posts 48 will support a third set of corner support pieces 20 (after placement of the third tray 24 on the second set of corner support pieces 20) to provide for a fourth tray level.

Figure 8:
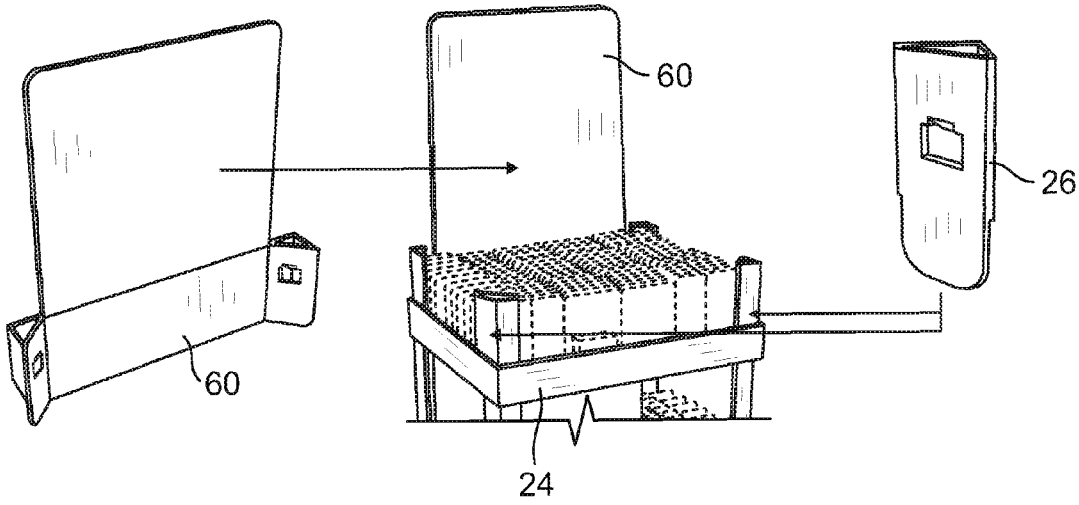
FIG. 8 is a perspective view of a top level or tray of the display system and an illustration of an advertizing panel and corner insert for use in the top tray.

FIG. 8 shows the fourth corrugated tray 24, and illustrates the construction of an advertising panel 60 and foldable corner inserts 62. The advertising panel 60 can be folded and inserted into the fourth tray after shipping. Both the advertising panel 60 and the corner inserts can be formed from a thick paper or a corrugated material.

Each of the trays of the display system 10 is designed to hold a plurality of goods. In this regard, each tray can include the same goods, or one or more different types of goods. Moreover, the trays can be loaded prior to shipment.

To hold, align, separate and/or position the goods, one or more filler, divider or spacer members can be utilized in a tray. Such members can be formed from paper or a corrugated material, and can be configured to take on a variety of shapes (typically determined by the size, shape and number of the goods being displayed in a tray). Certain members can be filler inserts positioned to hold the goods in place and/or protect the goods during transport. These members can then be removed at the destination location for proper display of the goods. Additionally, the members can include designs, colors or advertising to enhance the "look" of the display system 10.

Figure 9A:
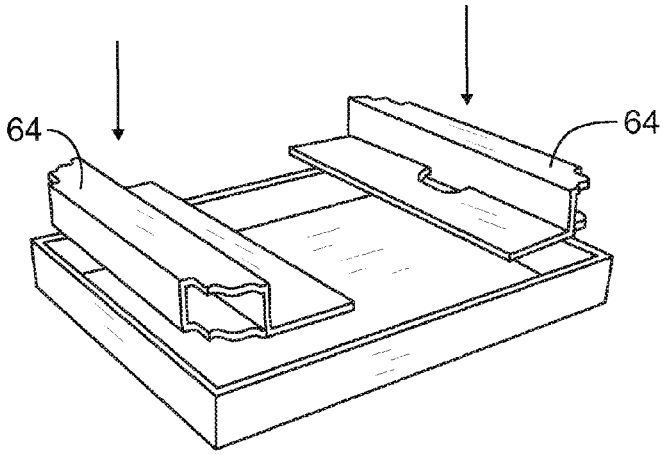
FIGS. 9A and 9B are perspective views of a tray including a spacer member and divider member in accordance with an aspect of the present invention.
Figure 9B:
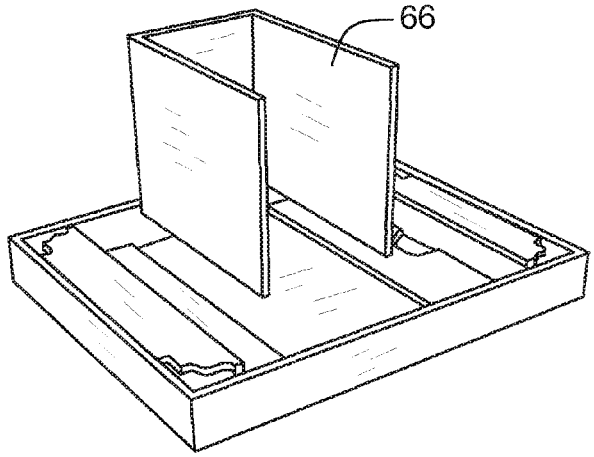

FIGS. 9A and 9B show the placement of a first side spacer member 64 and a second side spacer member 64, and a divider panel member 66 in a tray. The first and second side spacer members 64 and divider panel member 66 can be used to support, align and separate a number of different types of goods placed in the tray. Each tray of the display system 10 can include the same or different members as necessary to support the particular goods displayed in the tray.

Figure 10:
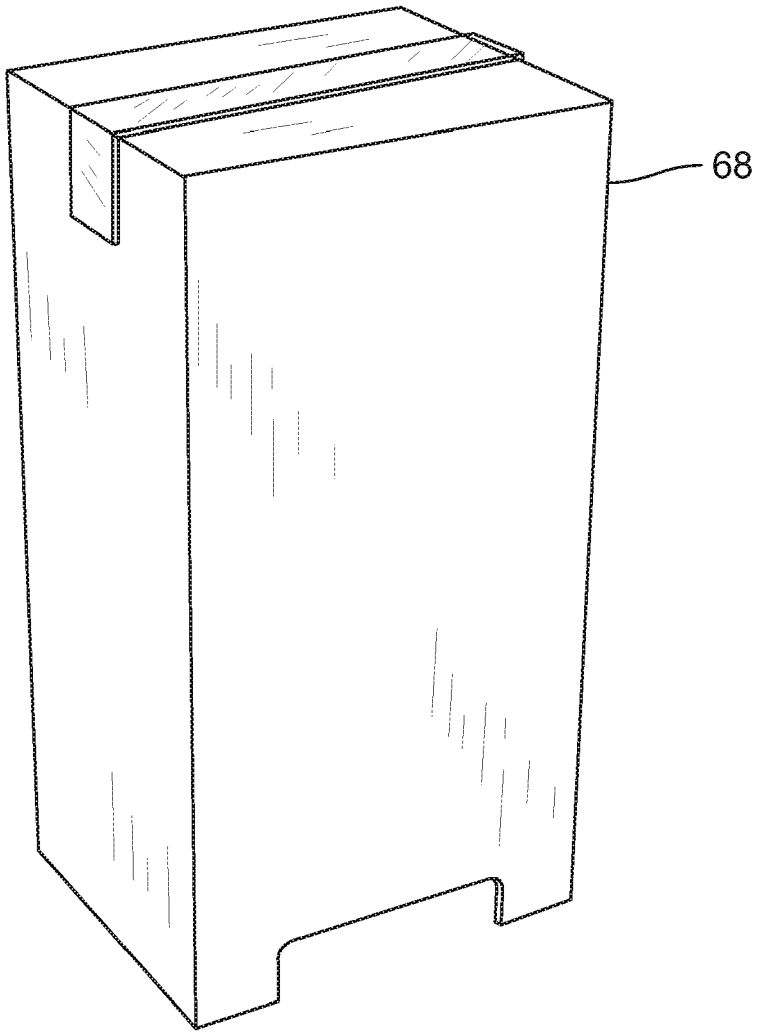
FIG. 10 is a perspective view of a shipping container for transporting a display system in accordance with the present invention; and, FIG. 11 is a perspective of a caster base for use with a pallet in accordance with the present invention.

The entire display system 10 is preferably set up, loaded with goods and shipped in a container 68 to a retail store or other similar location. FIG. 10 shows a container 68 configured to enclose the display system 10. The shipping container can include an open bottom area 71 to allow for use of a forklift or other similar apparatus to move the shipping container 34.

Figure 11:
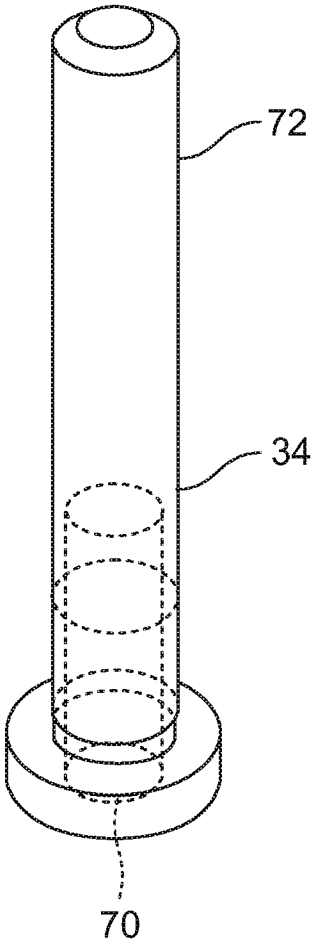

A caster base 34 for use with the pallet 12 is shown in FIG. 11. The caster base 34 includes a receiving portion 70 (e.g., an aperture) in the bottom of the caster base 34. The wheels include a cylindrical extension which is inserted into the receiving portion 70 of the caster base 34. The caster base 34 also includes an upper portion 72 which extends upward from the upper surface of the pallet 12 and first tray 16.

While the specific embodiments have been illustrated and described, numerous modifications come to mind without significantly departing from the spirit of the invention and the scope of protection is only limited by the scope of the accompanying Claims.

What is claimed is:

1. A display system comprising:

a base including a pallet supported by a plurality of wheels extending from a lower surface of the pallet, the base including a first corrugated tray supported on an upper surface of the pallet, the first corrugated tray configured to support a plurality of goods;

a first plurality of joiner posts extending upward from the pallet;

a first plurality of corner extrusion pieces, wherein each corner extrusion piece of the first plurality of corner extrusion pieces is positioned over one of the joiner posts of the first plurality of joiner posts;

a second corrugated tray supported by the plurality of joiner posts, the second corrugated tray configured to support a plurality of goods;

a second plurality of joiner posts extending upward from the second corrugated tray wherein each of the second set of joiner posts is positioned on one of the first plurality of joiner posts;

a second plurality of corner extrusion pieces, wherein each corner extrusion piece of the second plurality of corner extrusion pieces is positioned over one of the joiner posts of the second plurality of joiner posts; and, a third corrugated tray supported by the second plurality of joiner posts, the third tray configured to support a plurality of goods.

2. The display system of claim 1 further comprising a first corrugated support piece disposed in the first tray, wherein the first corrugated support piece is configured to control the positioning of the plurality of goods in the first tray.

3. The display system of claim 1 wherein the pallet is formed from wood.

4. The display system of claim 1 wherein the pallet is generally rectangular and the first plurality of joiner posts extend upward from corners of the pallet.

5. The display system of claim 1 wherein the corner extrusion piece includes a hollow cylindrical central portion configured to enclose a joiner post.

6. The display system of claim 5 wherein the corner extrusion piece includes a first planar portion extending from the central portion and second planar portion extending from the central portion.

7. The display system of claim 1 further comprising a third set of joiner posts extending upward from the third corrugated tray, and a fourth corrugated tray supported by the third plurality of joiner posts.

8. The display system of claim 7 including a corrugated advertising panel disposed on an upper surface of the fourth corrugated tray.

9. The display system of claim 1 further comprising a shipping container for shipping the display system, the shipping container having a base portion configured to support the pallet portion of the display system, and a main body portion connectable to the base portion for enclosing the display system.

10. A display system comprising:

a base including a pallet supported by a plurality of wheels extending from a lower surface of the pallet, the base including a first corrugated tray supported on an upper surface of the pallet, the first corrugated tray configured to support a plurality of goods;

a first plurality of joiner posts extending upward from the pallet;

a first plurality of corner extrusion pieces, wherein each corner extrusion piece of the first plurality of corner extrusion pieces is positioned over one of the joiner posts of the first plurality of joiner posts, and wherein each corner extrusion piece includes a hollow cylindrical central portion configured to enclose a joiner post and a first planar portion extending from the central portion and second planar portion extending from the central portion;

a second corrugated tray supported by the plurality of joiner posts, the second corrugated tray configured to support a plurality of goods;

a second plurality of joiner posts extending upward from the second corrugated tray wherein each of the second set of joiner posts is positioned on one of the first plurality of joiner posts; and, a third corrugated tray supported by the second plurality of joiner posts, the third tray configured to support a plurality of goods.

* * * * *